US005952273A

United States Patent [19]

Suzuki et al.

[11] Patent Number: 5,952,273

[45] Date of Patent: Sep. 14, 1999

[54] GREASE COMPOSITION FOR CONSTANT VELOCITY JOINTS

[75] Inventors: Yoichi Suzuki; Takashi Okaniwa, both of Fujisawa; Yukio Asahara, Shizuoka-ken; Keizo Nagasawa, Iwata-shi; Mitsuhiro Kakizaki; Kiyoshi Takeuchi, both of Fujisawa; Yukio Hasegawa; Shinichi Takabe, both of Iwata-shi, all of Japan

[73] Assignees: Kyodo Yushi Co., Ltd,, Tokyo; NTN Corporation, Osaka, both of Japan

[21] Appl. No.: 09/047,394

[22] Filed: Mar. 25, 1998

[30] Foreign Application Priority Data

Mar. 31, 1997 [JP] Japan ..... 9-080121
Mar. 31, 1997 [JP] Japan ..... 9-080122

[51] Int. Cl.[6] ..... C01M 141/12; C01M 141/06; C01M 141/08; C01M 141/10

[52] U.S. Cl. ..... 508/168; 508/169; 508/364; 508/365; 508/376; 508/377; 508/378; 508/379; 508/380

[58] Field of Search ..... 508/168, 169, 508/365, 364, 376, 377, 378, 379, 380

[56] References Cited

U.S. PATENT DOCUMENTS

| | | | |
|---|---|---|---|
| 3,840,463 | 10/1974 | Froeschmann et al. . | |
| 4,536,308 | 8/1985 | Pehler et al. . | |
| 4,759,859 | 7/1988 | Waynick . | |
| 4,787,992 | 11/1988 | Waynick . | |
| 4,830,767 | 5/1989 | Waynick | 508/163 |
| 4,840,740 | 6/1989 | Sato et al. . | |
| 4,902,435 | 2/1990 | Waynick | 508/163 |
| 4,986,923 | 1/1991 | Waynick | 508/156 |
| 5,126,062 | 6/1992 | Barnes . | |
| 5,160,645 | 11/1992 | Okaniwa et al. . | |
| 5,207,936 | 5/1993 | Anzai et al. . | |
| 5,449,471 | 9/1995 | Ozaki et al. . | |
| 5,462,683 | 10/1995 | Kinoshita et al. | 508/155 |
| 5,498,357 | 3/1996 | Naka et al. . | |
| 5,512,188 | 4/1996 | Kinoshita et al. | 508/155 |
| 5,516,439 | 5/1996 | Takeuchi et al. . | |
| 5,569,643 | 10/1996 | Kinoshita et al. | 508/155 |
| 5,585,336 | 12/1996 | Ozaki et al. | 508/365 |
| 5,589,444 | 12/1996 | Hatakeyama . | |
| 5,604,187 | 2/1997 | Takeuchi et al. . | |
| 5,607,906 | 3/1997 | Okaniwa et al. . | |
| 5,607,907 | 3/1997 | Watanabe et al. . | |
| 5,624,889 | 4/1997 | Ozaki et al. | 508/162 |
| 5,672,571 | 9/1997 | Hatakeyama et al. . | |

FOREIGN PATENT DOCUMENTS

| | | |
|---|---|---|
| 0 508 115 A1 | 10/1992 | European Pat. Off. . |
| 0 796 910 | 9/1997 | European Pat. Off. . |
| 62-207397 | 9/1987 | Japan . |
| 2 255 346 | 11/1992 | United Kingdom . |
| 2 260 142 | 4/1993 | United Kingdom . |
| WO 94/11470 | 5/1994 | WIPO . |
| WO 96/02615 | 2/1996 | WIPO . |

OTHER PUBLICATIONS

Chemical Abstract, AN 128:104227, DE 197 23 960, Dec. 11, 1997.

*Primary Examiner*—Margaret Medley
*Attorney, Agent, or Firm*—Oblon, Spivak, McClelland, Maier & Neustadt, P.C.

[57] ABSTRACT

A grease composition for constant velocity joints comprising: (a) a base oil; (b) a diurea thickener of the formula (1):

$$R^1NH—CO—NH—C_6H_4\text{-p-}CH_2—C_6H_4\text{-p-}NH—CO—NHR^2$$

wherein $R^1$ and $R^2$ may be the same or different and represent aryl groups having 6 or 7 carbon atoms or cyclohexyl groups; (c) a molybdenum dialkyldithiocarbamate; (d) molybdenum disulfide; (e) at least one extreme pressure agent selected from the group consisting of zinc dithiophosphates, and sulfur-nitrogen extreme pressure agents; and (f) a phosphorus-free sulfur extreme pressure agent. The grease composition has low coefficient of friction, good performance for reducing induced thrust and high durability.

10 Claims, 2 Drawing Sheets

GREASE COMPOSITION FOR CONSTANT VELOCITY JOINTS

BACKGROUND OF THE INVENTION

This invention relates to a grease composition for constant velocity joints used in motorcars, in particular for plunging type constant velocity joints and fixed type constant velocity joints, and more particularly, to a grease composition for constant velocity joints, which can effectively lubricate portions of such constant velocity joints which are liable to wear or cause abnormal vibration, to effectively reduce the friction of joints, to effectively reduce the occurrence of the vibration and to increase the life of the joints.

Recently, the number of front engine front wheel drive (FF-type) motorcars has rapidly increased for ensuring light weight and making interior space as large as possible. The number of functional four wheel drive motorcars (4WD) has also increased. Constant velocity joints (CVJ) suitable for the FF or 4WD motorcars have been used widely. Constant velocity joints are roughly classified into plunging type constant velocity joints and fixed type constant velocity joints. Typical plunging type constant velocity joints include double offset type constant velocity joints (DOJ), tripod type constant velocity joints (TJ) and cross groove type constant velocity joints (LJ). Typical fixed type constant velocity joints include Rzeppa type constant velocity joints (BJ) and undercut-free type constant velocity joints (UJ). Among the CVJs, an example of double offset type constant velocity joints (DOJ) used as plunging type constant velocity joints is illustrated in FIG. 1. In the DOJ, when it transmits torque at actuating angle, it causes complicated rolling and sliding motions in fitting between track groove 3 of outer ring 1, track groove 4 of inner ring 2 and ball 5 and accordingly, axial force is generated due to frictional resistance in plunging portions. The force is called induced thrust. Since the DOJ is provided with the track groove 3 in the inner surface of the outer ring 1 at 60 degree interval, six times of induced thrust are generated in every one revolution.

If the cycle of induced thrust generation agrees with the specific frequency of engine, body, suspension, and the like, sympathetic vibration is induced in the body, which gives the occupants uncomfortable feeling. Accordingly, it is desired to make the induced thrust as low as possible. Further, beating and/or confined noise are generated in a motorcar in high-speed driving. Moreover, as motorcars are made light weight and high power, the lubricating condition under which the DOJ is used gets much severer and therefore, it is necessary to increase the durability of the joints.

Conventional lithium soap thickened extreme pressure greases containing sulfur-phosphorus extreme pressure agents or lithium soap thickened extreme pressure greases containing molybdenum disulfide have disadvantages that they are low in vibration resistance and durability since they are liable to wear under high surface pressure. JP-A 62-207397 discloses an extreme pressure grease which comprises a sulfur-phosphorus extreme pressure agent which is a combination of molybdenum dialkyldithiocarbamate with at least one member selected from the group consisting of fats and oils sulfide, olefin sulfide, tricresylphosphate, trialkylthiophosphate and zinc dialkyldithiophosphate. However, the grease is not sufficient in giving quietness and durability.

Since the power transmission and steering are conducted through front wheels in FF and 4WD motorcars, constant velocity joints are necessary to ensure smooth power transmission even when a handle is fully steered. In general, fixed type constant velocity joints are used in the wheel side where lubricating condition is extremely severe due to high operating angle. Accordingly, the joints are liable to wear under high surface pressure and to thereby undergo damage in short period of time. In the past, lithium soap thickened extreme pressure greases containing sulfur-phosphorus extreme pressure agents or lithium soap thickened extreme pressure greases containing molybdenum disulfide have been used widely as a grease for constant velocity joints used in such high surface pressure conditions under which the joints are easily worn.

SUMMARY OF THE INVENTION

Accordingly, an object of the present invention is to provide a novel grease composition for constant velocity joints, which has low coefficient of friction, good performance for reducing induced thrust and high durability.

Another object of the present invention is to provide a grease composition for constant velocity joints, which effectively lubricates the constant velocity joints to effectively reduce friction and wear and which has good heat resistance and durability.

It is known that there is a relationship between coefficient of friction and induced thrust generated. It is therefore considered that a grease having lower coefficient of friction would be suitable for lubricating a joint which is used under such conditions that friction and wear and vibration are liable to occur. The inventors of this invention have evaluated various grease samples for vibration resistance by determining induced thrust in real joints and coefficient of friction by Sawin type friction and wear tester, which coefficient of friction has good correlation with induced thrust in real joints, and for durability by the test wherein real joints are used. The present invention has been accomplished based on the discovery obtained by the above mentioned evaluation tests.

The present invention provides a grease composition for constant velocity joints comprising:

(a) a base oil;

(b) a diurea thickener of the formula (1):

$$R^1NH—CO—NH—C_6H_4\text{-p-}CH_2—C_6H_4\text{-p-}NH—CO—NHR^2$$

wherein $R^1$ and $R^2$ may be the same or different and represent aryl groups having 6 or 7 carbon atoms or cyclohexyl groups;

(c) a molybdenum dialkyldithiocarbamate;

(d) molybdenum disulfide;

(e) at least one extreme pressure agent selected from the group consisting of zinc dithiophosphates, and sulfur-nitrogen extreme pressure agents; and (f) a phosphorus-free sulfur extreme pressure agent.

The grease composition for constant velocity joints of the present invention is excellent as the one for plunging type constant velocity joints and fixed type constant velocity joints.

Among the grease compositions of the present invention, those for plunging type constant velocity joints preferably comprises the following components:

(a) a base oil;

(b) a diurea thickener of the formula (1);

(c) a molybdenum dialkyldithiocarbamate;

(d) molybdenum disulfide;

(e) a zinc dithiophosphate; and (f) a phosphorus-free sulfur extreme pressure agent.

Among the grease compositions of the present invention, those for fixed type constant velocity joints preferably comprise the following components:

(a) a base oil;
(b) a diurea thickener of the formula (1);
(c) a molybdenum dialkyldithiocarbamate;
(d) molybdenum disulfide;
(e) a sulfur-nitrogen extreme pressure agent; and
(f) a phosphorus-free sulfur extreme pressure agent.

The grease composition for constant velocity joints of the present invention preferably further comprises (g) at least one compound selected from the group consisting of molybdenum dialkyldithiophosphates and sulfur-containing organic tin compounds.

Figure 1:
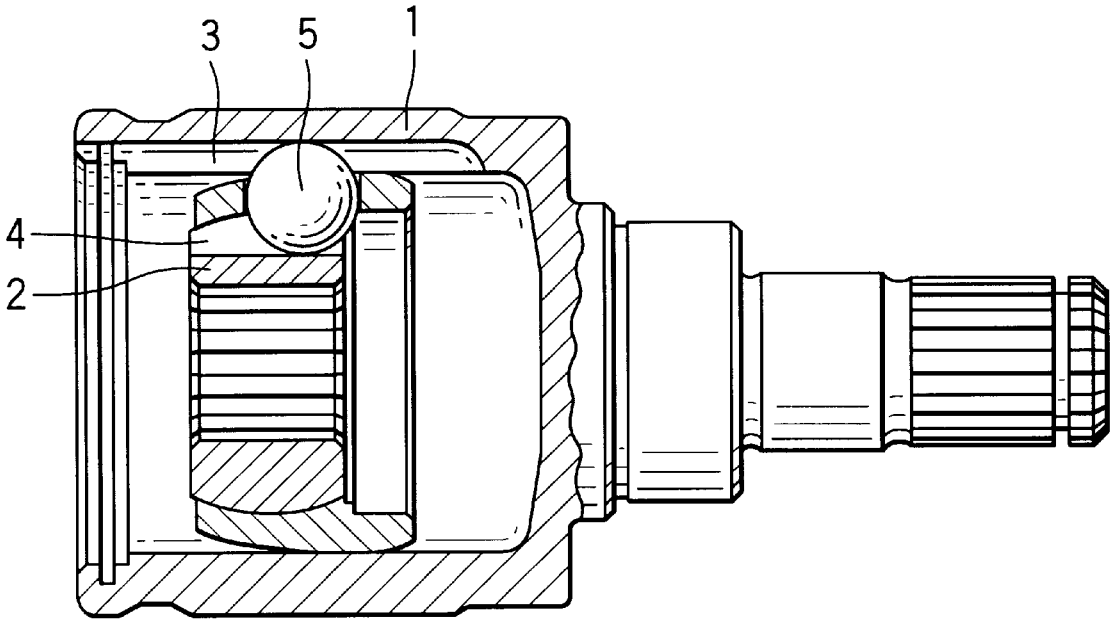
FIG. 1 is a partially cross sectional side view of an example of double offset joints to which the grease composition of the present invention is suitably applied.

1: outer ring, 2: track groove, 3: inner ring, 4: track groove, 5: ball, 6: revolution ring, 7: steel ball, 8: sponge, 9: air slide, 10: load cell.

DESCRIPTION OF THE PREFERRED EMBODIMENTS

The present invention will hereunder be explained in more detail.

The base oil as Component (a) used in the present invention is not restricted to specific ones and may be, for instance, mineral oils, ester type synthetic oils, ether type synthetic oils, hydrocarbon type synthetic oils or mixture thereof.

The diurea thickener as Component (b) used in the present invention is represented by the formula (1):

$$R^1NH—CO—NH—C_6H_4\text{-p-}CH_2—C_6H_4\text{-p-}NH—CO—NHR^2 \quad (1)$$

wherein $R^1$ and $R^2$ may be the same or different and represent aryl groups having 6 or 7 carbon atoms or cyclohexyl groups.

The diurea thickener may be obtained by the reaction between monoamine such as aniline, p-toluidine, and cyclohexylamine, and diphenylmethane-4,4'-diisocyanate.

The diurea grease using the diurea thickener as Component (b) (the diurea grease of the present invention) has more stable micellar structure of the thickener even under shearing condition than diurea grease using aliphatic amine (aliphatic diurea grease) or lithium soap thickened grease (lithium grease), and has good adherability to metal surface to show stronger buffering action to prevent the thickener from being brought into contact with the metal surface.

The molybdenum dialkyldithiocarbamate as Component (c) used in the present invention is preferably represented by the following formula (2):

$$[R^3R^4N—CS—S]_2—Mo_2OmSn \quad (2)$$

wherein $R^3$ and $R^4$ may be the same or different and represent alkyl groups having 1 to 24 carbon atoms, m+n=4, m is 0 to 3 and n is 4 to 1.

The compounds of the formula (2) are known solid lubricants and disclosed in for example JP-B-45-24562 (those of the formula wherein m is 2.35 to 3 and n is 1.65 to 1), JP-B-51-964 (those of the formula wherein m is 0 and n is 4) and JP-B-53-31646 (those of the formula wherein m is 0.5 to 2.3 and n is 3.5 to 1.7).

The molybdenum disulfide as Component (d) used in the present invention has widely been used as solid lubricants. The molybdenum disulfide is easily sheared under the sliding motions through the formation of a thin layer since it has a layer lattice structure and it shows effects of preventing metal contact and seizure of joints.

If the molybdenum disulfide is used in excess amount, it increases coefficient of friction and has a bad influence on vibration resistance. Further, it may increase friction and wear depending on lubricating condition.

Preferred examples of the zinc dithiophosphates as Component (e) used in the present invention include those of the following formula (3):

$$[(R^5O)_2—PS—S]_2—Zn \quad (3)$$

wherein $R^5$ represents an alkyl group having 1 to 24 carbon atoms or an aryl group having 6 to 30 carbon atoms.

Particularly preferred are those of the formula (3) wherein $R^5$ is a primary or secondary alkyl group having 3 to 8 carbon atoms.

Preferred examples of the sulfur-nitrogen extreme pressure agents as Component (e) used in the present invention include the one whose sulfur content is 5 to 20% by weight and whose nitrogen content is 1 to 10% by weight.

Preferred examples of the phosphorus-free sulfur extreme pressure agents as Component (f) used in the present invention include the one whose sulfur content is 35 to 50% by weight.

Preferred examples of the molybdenum dialkyldithiophosphate as Component (g) used in the present invention include those of the following formula (4):

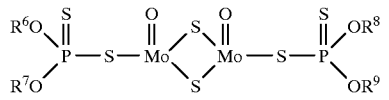

(4)

wherein $R^6$, $R^7$, $R^8$ and $R^9$ represent independently primary or secondary as alkyl groups having 1 to 24 carbon atoms, preferably 3 to 20 carbon atoms or aryl groups having 6 to 30 carbon atoms, preferably 8 to 18 carbon atoms.

Preferred examples of the sulfur-containing organic tin compounds as Component (g) used in the present invention include those of the following formula (5):

$$(R^{10})_mSn(X)_{4-m} \quad (5)$$

wherein $R^{10}$ represents an alkyl group, X represents —S—$(CH_2)$n—CO—$OR^{11}$ or —S—$(CH_2)$n—O—CO—$R^{11}$, $R^{11}$ represents an alkyl or alkenyl group, n is an integer of 1 to 18, m represents an integer of 0 to 3, and if more than one $R^{10}$ or X are present, they may be the same or different.

Specific examples of the organic tin compounds include dimethyl tin bis(isooctylthioglycol), monomethyl tin tris (isooctylthioglycol), and di(n-octyl) tin bis (isooctylmercaptoacetate).

The grease composition for constant velocity joints of the present invention preferably comprises, on the basis of the total weight of the composition, 1 to 25% by weight of the diurea thickener (b); 0.1 to 5.0% by weight of the molybdenum dialkyldithiocarbamate (c); 0.1 to 5% by weight of the molybdenum disulfide (d); 0.05 to 3% by weight of the extreme pressure agent selected from the group consisting of zinc dithiophosphates, and sulfur-nitrogen extreme pressure agents (e); and 0.1 to 5% by weight of the phosphorus-free sulfur extreme pressure agent.

The grease composition for plunging type constant velocity joints of the present invention preferably comprises, on the basis of the total weight of the composition, 1 to 25% by weight of the diurea thickener (b); 0.1 to 5.0% by weight of the molybdenum dialkyldithiocarbamate (c261 ); 0.1 to 1% by weight of the molybdenum disulfide (d); 0.1 to 3% by weight of the zinc dithiophosphate (e); and 0.1 to 5% by weight of the phosphorus-free sulfur extreme pressure agent.

The grease composition for fixed type constant velocity joints of the present invention preferably comprises, on the basis of the total weight of the composition, 1 to 25% by weight of the diurea thickener (b); 0.1 to 5.0% by weight of the molybdenum dialkyldithiocarbamate (c); 0.1 to 5% by weight of the molybdenum disulfide (d); 0.05 to 3% by weight of the sulfur-nitrogen extreme pressure agent (e); and 0.1 to 5% by weight of the phosphorus-free sulfur extreme pressure agent.

If the grease composition for constant velocity joints of the present invention comprises Component (g): at least one compound selected from the group consisting of molybdenum dialkyldithiophosphates and sulfur-containing organic tin compounds, the content of the component is preferably 0.1 to 5% by weight, more preferably 1 to 3% by weight on the basis of the total weight of the composition.

The present invention will hereunder be described in more detail with reference to the following non-limitative working Examples and Comparative Examples.

EXAMPLES 1 TO 4 AND COMPARATIVE EXAMPLES 1 TO 6

There were added, to a container, 4100 g of a base oil and 1012 g of diphenylmethane-4,4'-diisocyanate and the mixture was heated to a temperature between 70 and 80° C. To another container, there were added 4100 g of a base oil, 563g of cyclohexylamine and 225g of aniline and the mixture was heated to a temperature between 70 and 80° C. and added to the foregoing container. The mixture was then reacted for 30 minutes with sufficient stirring, the temperature of the reaction system was raised up to 160° C. with stirring and the reaction system was allowed to cool to give a base urea grease A. To the base grease A, there were added the following additives listed in Table 1 in amounts (by weight) likewise listed in Table 1 and an optional and additional amount of the base oil and the penetration of the resulting mixture was adjusted to the No. 1 grade by a three-stage roll mill.

In all of the above mentioned Examples and Comparative Examples, a mineral oil having the following properties was used as the base oil.

| | | |
|---|---|---|
| Viscosity: | at 40° C. | 141 $mm^2/s$ |
| | at 100° C. | 13.5 $mm^2/s$ |
| Viscosity Index: | 89 | |

Moreover, a commercially available organic molybdenum grease and commercially available molybdenum disulfide grease were used as the greases of Comparative Examples 5 and 6, respectively.

Physical properties of these greases were evaluated according to the methods detailed below. The results thus obtained and penetration (60W) (according to JIS K 2220) and dropping point (° C.) (according to JIS K 2220) are also summarized in Table 1.

1. Friction and Wear Test

Figure 2:
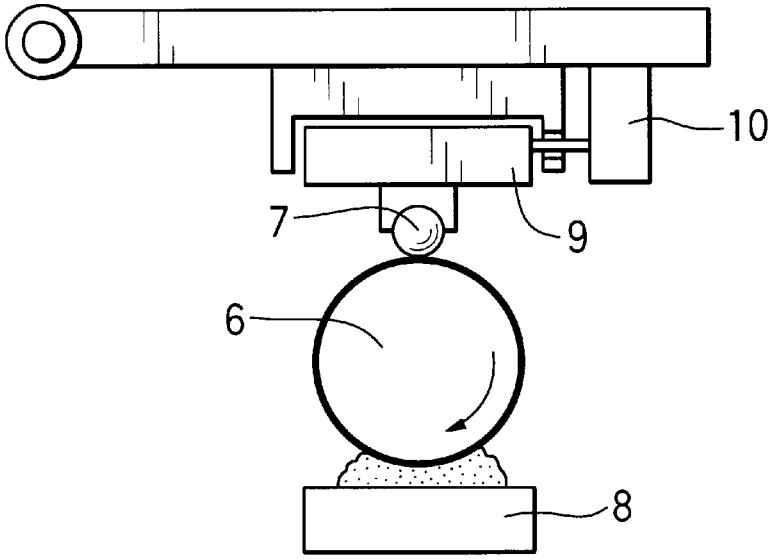
FIG. 2 is a schematic view which explains the method for measuring coefficient of friction using Sawin type friction and wear tester.
Figure 3:
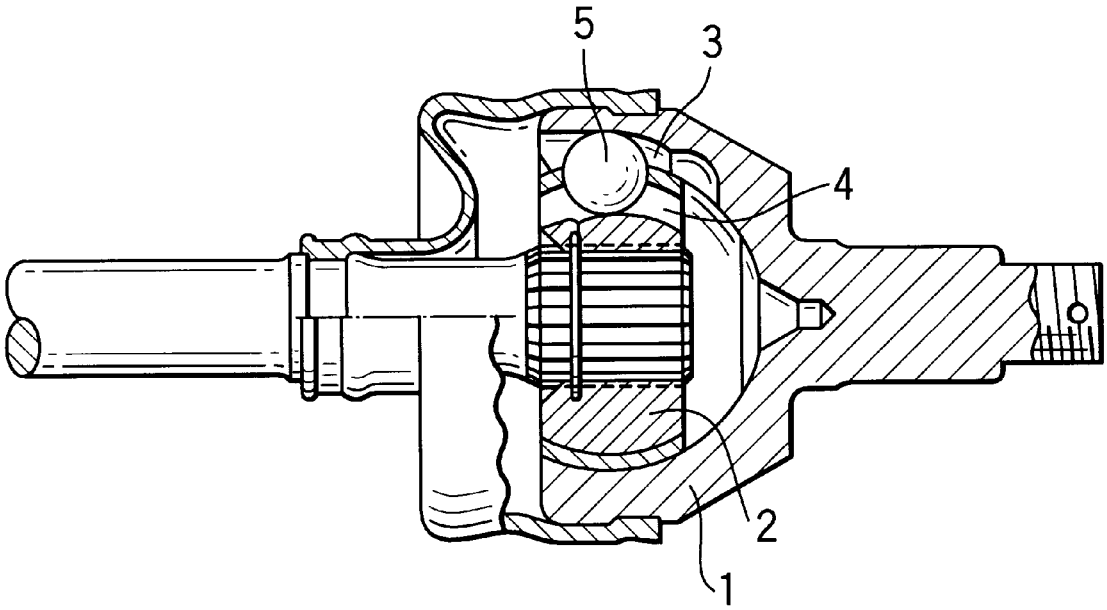
FIG. 3 is a partially cross sectional side view of an example of Rzeppa joints to which the grease composition of the present invention is suitably applied.

A coefficient of friction was measured by Sawin type friction and wear tester. The Sawin type friction and wear tester is illustrated in FIG. 2 wherein a steel ball 7 of the diameter of ¼ inch is pressed on revolution ring 6 having the diameter of 40 mm and the thickness of 4 mm. The revolution ring 6 is revolved at the circumferential velocity of 108 m/minute, to which a load of 1 kgf is applied. The grease was supplied to the surface of the revolution ring from the lower end of the ring through sponge 8. The motion of air slide 9 which supports the steel ball was detected by load cell 10. The time for the test was 10 minutes. A coefficient of friction was measured 10 minutes after the test was initiated.

2. Test for Measuring Induced Thrust

Real joints (double offset joints) were revolved under a given actuation angle and torque. An axial force generated was determined as induced thrust which was expressed as a reduction ratio (%) against the induced thrust generated when the commercially available molybdenum disulfide grease (Comparative Example 6) was used.

| Test conditions | |
|---|---|
| The number of revolution | 900 rpm |
| Torque | 15 kgf · m |
| Angle | 5° |
| Time of the test | 5 minutes after the initiation of the test |

3. Durability Test (Durability (a))

Real joints (double offset joints) were used to evaluate durability of the greases under the following conditions.

| Test conditions | |
|---|---|
| The number of revolution | 1500 rpm |
| Torque | 30 kqf · m |
| Angle | 5° |

Criterion for evaluation

A: excellent, B: good, C: baddish, D: bad

TABLE 1

| | Example | | | | Comparative Example | | | | | |
|---|---|---|---|---|---|---|---|---|---|---|
| | 1 | 2 | 3 | 4 | 1 | 2 | 3 | 4 | 5 | 6 |
| Base grease | 93.5 | 92.0 | 95.8 | 93.5 | 94.5 | 96.5 | 95.95 | 93.95 | — | — |
| Grease A | | | | | | | | | | |
| Additives | | | | | | | | | | |
| 1) MoDTC (A) | 3.0 | 3.0 | 3.0 | — | 3.0 | — | 0.05 | 3.0 | — | — |
| 2) MoDTC (B) | — | — | — | 3.0 | — | — | — | — | — | — |
| 3) $MoS_2$ | 0.5 | 1.0 | 0.2 | 0.5 | 0.5 | 0.5 | 1.0 | 1.0 | — | — |
| 4) ZnDTP | 1.0 | 2.0 | 0.5 | 1.0 | — | 1.0 | 1.0 | 0.05 | — | — |
| 5) S-EPA | 2.0 | 2.0 | 0.5 | 2.0 | 2.0 | 2.0 | 2.0 | 2.0 | — | — |

TABLE 1-continued

| | Example | | | | Comparative Example | | | | | |
|---|---|---|---|---|---|---|---|---|---|---|
| | 1 | 2 | 3 | 4 | 1 | 2 | 3 | 4 | 5 | 6 |
| total | 100 | 100 | 100 | 100 | 100 | 100 | 100 | 100 | — | — |
| 6) Pen. (60 W) | 328 | 325 | 326 | 327 | 326 | 329 | 324 | 325 | 325 | 285 |
| 7) D.P. (° C.) | 260< | 260< | 260< | 260< | 260< | 260< | 260< | 260< | 236 | 196 |
| 8) C.F. | 0.042 | 0.041 | 0.042 | 0.042 | 0.090 | 0.083 | 0.075 | 0.082 | 0.080 | 0.119 |
| 9) I.T. | −74 | −76 | −68 | −72 | −35 | −39 | −40 | −41 | −38 | ±0 |
| 10) Dura. (a) | A | A | A | A | C | D | C | B | D | D |

1) MoDTC (A): Molybdenum dialkyldithiocarbamate A (available from R. T. Vanderbilt Company under the trade name of Molyvan A)
2) MoDTC (B): Molybdenum dialkyldithiocarbamate B (available from R. T. Vanderbilt Company under the trade name of Molyvan 822)
3) $MoS_2$: Molybdenum disulfide (available from CLIMAX MOLYBDENUM under the trade name of Molysulfide, average diameter: 0.45 micron)
4) ZnDTP: Zinc dithiophosphate (available from Lubrizol Japan under the trade name of Lubrizol 1360)
5) S-EPA: Sulfur extreme pressure agent (available from Lubrizol Japan under the trade name of Anglamol 33)
6) Pen. (60W): Penetration according to JIS K 2220 at 60 W
7) D.P. (° C.): Dropping point according to JIS K 2220 (° C.)
8) C.F.: Coefficient of Friction
9) I.T.: Induced Thrust
10) Dura. (a): Durability (a)
Comparative Example 5: Commercially available organic molybdenum grease
Comparative Example 6: Commercially available molybdenum disulfide grease The results in Table 1 demonstrate that the grease compositions of the present invention have low coefficient of friction, effectively reduce induced thrust and have excellent durability.

EXAMPLES 5 TO 8 AND COMPARATIVE EXAMPLES 7 TO 9

The same procedures as in Example 1 were repeated to prepare a base urea grease A. To the base grease A, there were added the following additives listed in Table 2 in amounts (by weight) likewise listed in Table 2 and an optional and additional amount of the base oil and the penetration of the resulting mixture was adjusted to the No. 1 grade by a three-stage roll mill.

COMPARATIVE EXAMPLE 10

There were added, to a container, 4400 g of a base oil and 589 g of diphenylmethane-4,4'-diisocyanate and the mixture was heated to a temperature between 70 and 80° C. To another container, there were added 4400 g of a base oil and 611 g of octylamine and the mixture was heated to a temperature between 70 and 80° C. and added to the foregoing container. The mixture was then reacted for 30 minutes with sufficient stirring, the temperature of the reaction system was raised up to 160° C. with stirring and the reaction system was allowed to cool to give a base urea grease B. To the base grease B, there were added the following additives listed in Table 2 in amounts (by weight) likewise listed in Table 2 and an optional and additional amount of the base oil and the penetration of the resulting mixture was adjusted to the No. 1 grade by a three-stage roll mill.

COMPARATIVE EXAMPLE 11

There were added, to a container, 4314 g of a base oil and 600 g of 12-hydroxystearic acid and the mixture was heated to 80° C. To the mixture, there were added 430 g of an aqueous 20% lithium hydroxide solution. The mixture was stirred to conduct a saponification. After the saponification, the reaction mixture was heated to 210° C. and then cooled to 160° C. To the mixture, 5000 g of a base oil was added. The mixture was cooled to 100° C. with stirring to give a base lithium grease C. To the base grease C, there were added the following additives listed in Table 2 in amounts (by weight) likewise listed in Table 2 and an optional and additional amount of the base oil and the penetration of the resulting mixture was adjusted to the No. 1 grade by a three-stage roll mill.

In all of the above mentioned Examples and Comparative Examples, a mineral oil having the following properties was used as the base oil.

| | | |
|---|---|---|
| Viscosity: | at 40° C. | 141 $mm^2/s$ |
| | at 100° C. | 13.5 $mm^2/s$ |
| Viscosity Index: | 89 | |

Moreover, a commercially available molybdenum disulfide grease was used as the grease of Comparative Example 12.

Physical properties of these greases were evaluated according to the methods detailed below. The results thus obtained and penetration (60 W) (according to JIS K 2220) and dropping point (° C.) (according to JIS K 2220) are also summarized in Table 2.

4. Four-ball Friction and Wear Test According to ASTM D 2266

| | |
|---|---|
| The number of revolution | 1200 rpm |
| Load: | 40 kgf |
| Temperature: | 75° C. |
| Time: | 1 hour |

5. Durability Test (Durability (b))

Rzeppa joints (fixed type constant velocity joints) were used to evaluate durability of the greases under the following conditions.

| | Test condition I | Test condition II |
|---|---|---|
| The number of revolution | 200 rpm | 1500 rpm |
| Torque | 100 kgf · m | 30 kgf · m |
| Angle | 50 | 50 |

Criteria for evaluation

A: excellent, B: good, C: baddish, D: bad

TABLE 2

| | Example | | | | Comparative Example | | | | | |
|---|---|---|---|---|---|---|---|---|---|---|
| | 5 | 6 | 7 | 8 | 7 | 8 | 9 | 10 | 11 | 12 |
| Base grease | | | | | | | | | | |
| Grease A | 92.0 | 91.0 | 93.5 | 92.0 | 94.0 | 94.0 | 93.0 | — | — | — |
| Grease B | — | — | — | — | — | — | — | 92.0 | — | — |
| Grease C | — | — | — | — | — | — | — | — | 92.0 | — |
| Additives | | | | | | | | | | |
| 1) MoDTC (A) | 2.0 | 2.0 | 2.0 | — | — | 2.0 | 2.0 | 2.0 | 2.0 | — |
| 2) MoDTC (B) | — | — | — | 2.0 | — | — | — | — | — | — |
| 3) $MoS_2$ | 3.0 | 3.0 | 3.0 | 3.0 | 3.0 | 3.0 | 3.0 | 3.0 | 3.0 | — |
| 4) S/N-EPA | 1.0 | 2.0 | 0.5 | 1.0 | 1.0 | 1.0 | — | 1.0 | 1.0 | — |
| 5) S-EPA | 2.0 | 2.0 | 1.0 | 2.0 | 2.0 | — | 2.0 | 2.0 | 2.0 | — |
| total | 100 | 100 | 100 | 100 | 100 | 100 | 100 | 100 | 100 | — |
| 6) Pen. (60 W) | 328 | 325 | 326 | 327 | 326 | 329 | 324 | 325 | 326 | 285 |
| 7) D.P. (° C.) | 260< | 260< | 260< | 260< | 260< | 260< | 260< | 236 | 191 | 190 |
| 8) C.F. | 0.53 | 0.54 | 0.53 | 0.52 | 0.78 | 0.78 | 0.74 | 0.71 | 0.76 | 0.75 |
| 9) Durability (b) | | | | | | | | | | |
| I | A | A | A | A | D | D | C | C | D | D |
| II | A | A | A | A | D | D | C | D | C | D |

1) MoDTC (A): Molybdenum dialkyldithiocarbamate A (available from R. T. Vanderbilt Company under the trade name of Molyvan A)
2) MoDTC (B): Molybdenum dialkyldithiocarbamate B (available from R. T. Vanderbilt Company under the trade name of Molyvan 822)
3) $MoS_2$: Molybdenum disulfide (available from CLIMAX MOLYBDENUM under the trade name of Molysulfide, average diameter: 0.45 micron)
4) S/N-EPA: Sulfur-nitrogen extreme pressure agent (available from R. T. Vanderbilt Company under the trade name of Vanlube 601)
5) S-EPA: Sulfur extreme pressure agent (available from Lubrizol Japan under the trade name of Anglamol 33)
6) Pen. (60 W): Penetration according to JIS K 2220 at 60 W
7) D.P. (° C.): Dropping point according to JIS K 2220 (° C.)
8) C.F.: Coefficient of Friction
9) Dura. (b): Durability (b)
Comparative Example 12: Commercially available molybdenum disulfide grease The results in Table 2 demonstrate that the grease compositions of the present invention have low coefficient of friction, effectively lubricate constant velocity joints and have excellent durability.

EXAMPLES 9 TO 11

The same procedures as in Example 1 were repeated to prepare a base urea grease A. To the base grease A, there were added the following additives listed in Table 3 in amounts (by weight) likewise listed in Table 3 and an optional and additional amount of the base oil and the penetration of the resulting mixture was adjusted to the No. 1 grade by a three-stage roll mill.

According to the test methods for penetration, dropping point, friction and wear and induced thrust in Example 1 and the test methods for the four-ball friction and wear and durability in Example 5, the above greases were evaluated. The results are shown in Table 3.

TABLE 3

| | Example | | |
|---|---|---|---|
| | 9 | 10 | 11 |
| Base greases Grease A | 93.0 | 92.0 | 91.0 |
| Additives | | | |
| 1) MODTC (A) | 2.0 | 2.0 | 2.0 |
| 2) MODTC (B) | — | — | — |
| 3) $MOS_2$ | 1.0 | 1.0 | 1.0 |
| 4) S/N-EPA | 1.0 | 1.0 | 1.0 |
| 5) S-EPA | 2.0 | 2.0 | 2.0 |
| 6) MODTP | 1.0 | — | 1.0 |
| 7) Sn-EPA | — | 2.0 | 2.0 |
| total | 100 | 100 | 100 |
| 8) Pen.(60 W) | 326 | 325 | 328 |
| 9) D.P.(°C.) | 260< | 260< | 260< |
| 10) C.F. | 0.040 | 0.040 | 0.040 |
| 11) I.T. | −78 | −76 | −80 |
| 12) Dura (a) | A | A | A |

TABLE 3-continued

| | Example | | |
|---|---|---|---|
| | 9 | 10 | 11 |
| 13) Dura (b) | | | |
| I | A | A | A |
| II | A | A | A |

1) MoDTC(A): Molybdenum dialkyldithiocarbamate A (available from R. T. Vanderbilt Company under the trade name of Molyvan A)
2) MoDTC(B): Molybdenum dialkyldithiocarbamate B (available from R. T. Vanderbilt Company under the trade name of Molyvan 822)
3) $MOS_2$: Molybdenum disulfide (available from CLIMAX MOLYBDENUM under the trade name of Molysulfide, average diameter: 0.45 micron)
4) S/N-EPA: Sulfur-nitrogen extreme pressure agent (available from R. T. Vanderbilt Company under the trade name of Vanlube 601)
5) S-EPA: Sulfur extreme pressure agent (available from Lubrizol Japan under the trade name of Anglamol 33)
6) MoDTP: Molybdenum dialkyldithiophosphate (available from Asahi Denka under the trade name of Sakuralub 300)
7) Sulfur-containing organic tin compound (A mixture of dimethyl tin bis(isooctylthioglycol) and monomethyl tin tris (isooctylthioglycol) (75/25 by weight)
8) Pen.(60W): Penetration according to JIS K 2220 at 60 W
9) D.P. (CC): Dropping point according to JIS K 2220 (°C.)
10) C.F.: Coefficient of Friction
11) I.T.: Induced thrust
12) Dura. (a): Durability (a)
13) Dura. (b): Durability (b)

What is claimed is:

1. A grease composition comprising:

(a) a base oil and, on the basis of total weight of composition, the following components:

(b) 1 to 25% by weight of a diurea thickener of formula (1):

$$R^1NH—CO—NH—C_6H_4\text{-}p\text{-}CH_2—C_6H_4\text{-}p\text{-}NH—CO—NHR^2$$

wherein $R^1$ and $R^2$ may be the same or different and represent aryl groups having 6 or 7 carbon atoms or cyclohexyl groups;

(c) 0.1 to 5% by weight of a molybdenum dialkyldithiocarbamate;

(d) 0.1 to 5% by weight of molybdenum disulfide;

(e) 0.05 to 3% by weight of at least one extreme pressure agent selected from the group consisting of zinc dithiophosphates and sulfur-nitrogen extreme pressure agents other than a molybdenum dialkyldithiocarbamate; and (f) 0.1 to 5% by weight of a phosphorus-free sulfur extreme pressure agent other than a molybdenum dialkylthiocarbamate, molybdenum disulfide and a sulfur-containing organic tin compound.

2. The grease composition as claimed in claim 1, wherein said grease is for constant velocity joints.

3. The grease composition claim 1 wherein the grease composition further comprises (g) 0.1 to 5% by weight of at least one compound selected from the group consisting of molybdenum dialkyldithiophosphates and sulfur-containing organic tin compounds.

4. The grease composition claim 2 wherein said constant velocity joints are plunging type constant velocity joints.

5. The grease composition claim 2 wherein said constant velocity joints are fixed type constant velocity joints.

6. The grease composition as claimed in claim 1, comprising 0.05 to 3% by weight of a zinc dithiophosphate having the formula:

$$[(R^5O)_2—PS—S]_2—Zn$$

wherein $R^5$ represents an alkyl group having 1 to 24 carbon atoms or an aryl group having 6 to 30 carbon atoms.

7. The composition as claimed in claim 1, comprising 0.05 to 3% by weight of a zinc dithiophosphate.

8. The composition as claimed in claim 1, further comprising:

(g) 0.1 to 5% by weight of a sulfur-containing organic tin compound of the formula $$(R^{10})_mSn(X)_4\text{-}m$$

wherein $R^{10}$ represents an alkyl group, X represents $—S—(CH_2)_n—CO—OR^{11}$ or $—S—(CH_2)_n—O—CO—R^{11}$, $R^{11}$ represents an alkyl or alkenyl group, n is an integer of 1 to 18, and m represents an integer of 0 to 3, wherein if more than one $R^{10}$ or X are present they may be the same or different.

9. The composition as claimed in claim 3, comprising a sulfur containing organic tin compound selected from the group consisting of dimethyl tin bis(isooctylthioglycol), monomethyl tin tris(isooctylthioglycol), and di(n-octyl) tin bis(isooctylmercaptoacetate).

10. The grease composition as claimed in claim 1, wherein the sulfur-nitrogen extreme pressure agent has a sulfur content of 5 to 20% by weight and a nitrogen content of 1 to 10% by weight, and wherein the phosphorus-free sulfur extreme pressure agent has a sulfur content of 35 to 50% by weight.

* * * * *